United States Patent [19]

Kuroda

[11] 4,106,004

[45] Aug. 8, 1978

[54] TWIST DETECTING DEVICE

[76] Inventor: Mitura Kuroda, 16, Momoyama Mizuno Sakon Higashimachi, Fushimi-ku, Kyoto, Japan, 612

[21] Appl. No.: 769,321

[22] Filed: Feb. 16, 1977

[51] Int. Cl.[2] ..... G08B 21/00

[52] U.S. Cl. ..... 200/61.17; 28/227; 57/1 UN; 340/677

[58] Field of Search ..... 340/213 Q, 259, 267 R; 28/227

[56] References Cited

U.S. PATENT DOCUMENTS

| | | | |
|---|---|---|---|
| 3,611,342 | 10/1971 | Raaben | 340/259 |
| 3,756,524 | 9/1973 | Felix | 28/227 X |

*Primary Examiner*—Alvin H. Waring

*Attorney, Agent, or Firm*—Fidelman, Wolffe & Waldron

[57] ABSTRACT

A twist detecting device for use in a detwisting apparatus for a roped web of knit or woven fabric in a fabric processing system comprising a pair of sensing drums each having a plurality of axial grooves formed on at least a portion of the circumferential surface thereof and spaced apart from each other so that said roped web passes between said drums in a direction generally parallel with said grooves; means for supporting said drums rotatably about their respective axes so that as said twist in said rope is tightened, engagement of said twisted rope with said grooves on either one or both of said drums causes simultaneous rotation of said drums in the same direction, the direction of said rotation depending on the direction of said twist; and means for detecting said direction of rotation to produce a corresponding electrical signal which actuates a detwister so as to decrease or remove said twist in said roped web.

8 Claims, 8 Drawing Figures

13

36a
14
45
12
36
15
22L
35L
10
16
11

TWIST DETECTING DEVICE

This invention relates to an apparatus for detwisting the twist of a roped web of knit or woven fabric produced in a fabric processing system and more particularly to a twist detecting device for use in such a detwisting apparatus which detects the direction of the twist of such a roped web of fabric as it is spread and opened to its own width by a cloth guider, and sends corrective signals to a detwister to remove the twist of the roped web.

All known twist detectors in the art detect the inherent twist itself of the roped web of fabric caused in fabric processing operation. They are complicated in construction, heavy and bulky, have low sensitivity, and are unstable in operation and expensive. Moreover, such known detectors have a further disadvantage that they erroneously respond to an obstacle, such as a seam, fold or crease in the roped web of fabric or a foreign substance attached thereto.

Accordingly, the primary object of the invention is to provide a twist detector which is capable of quickly and precisely detecting the direction of twist in the roped web of fabric without making errors in the detection and sending detection signals to the detwister, which acts to remove the twist for subsequent proper spreading and opening operation of the web of fabric.

The invention will be described in detail with reference to the accompanying drawings, wherein.

Figure 1:
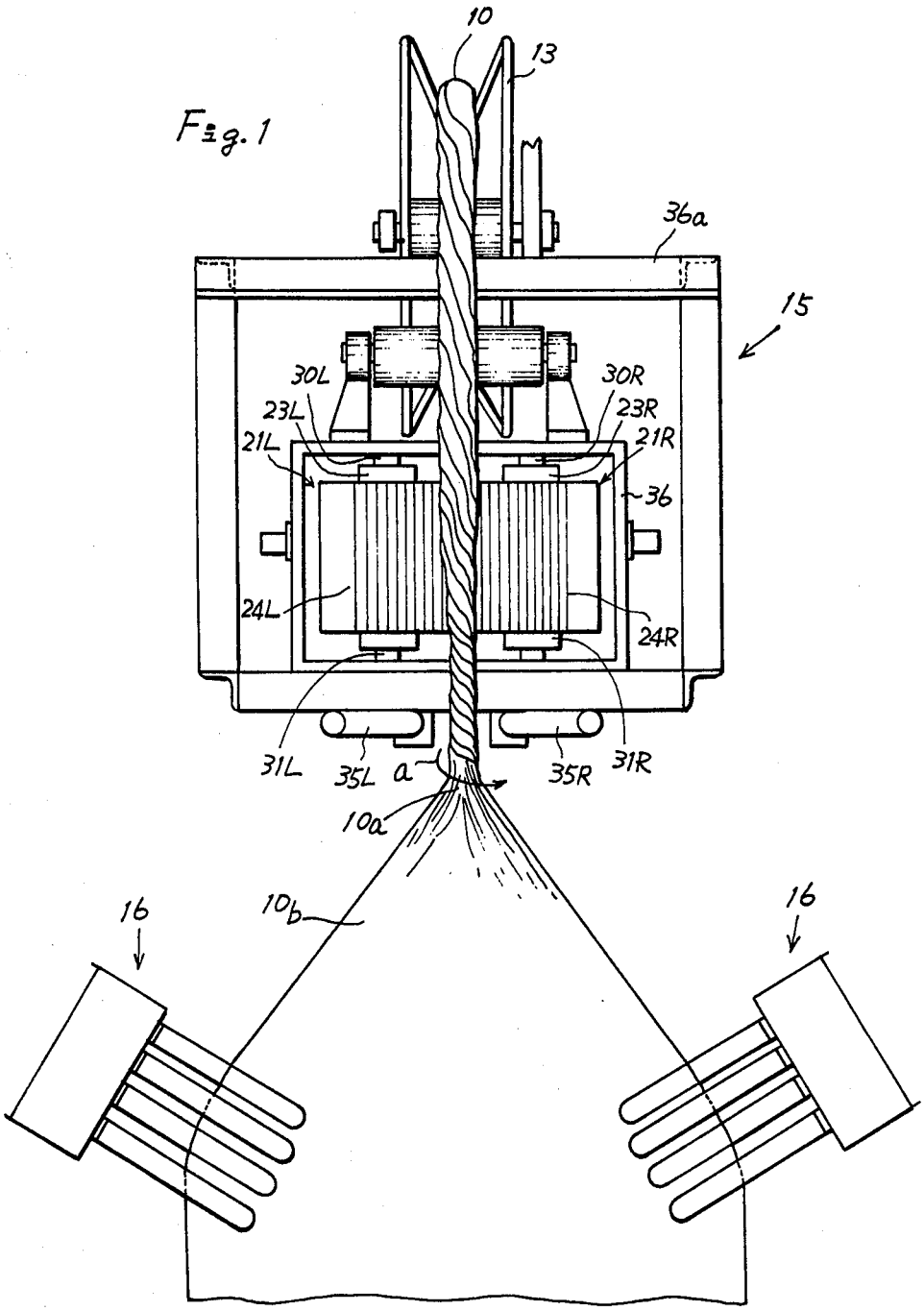
FIG. 1 is a front view of a twist detecting device embodying the invention as incorporated in a detwisting system.
Figure 2:
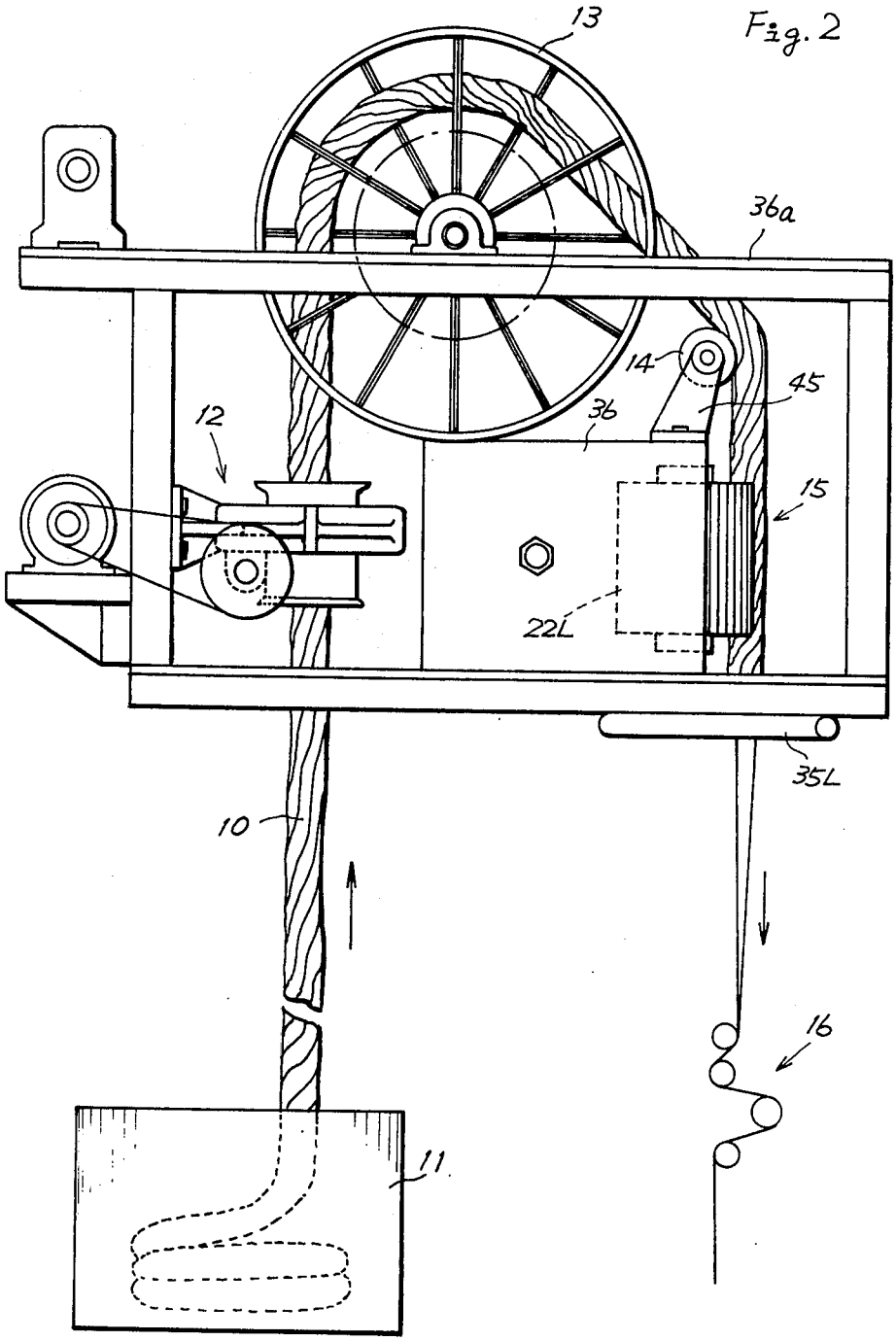
FIG. 2 is a side view of the detwisting system of FIG. 1.
Figure 3:
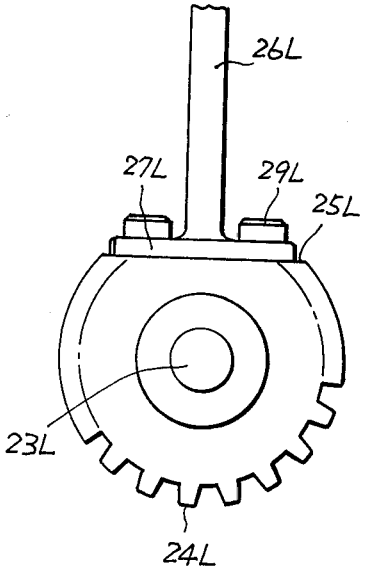
FIG. 3 is a top plan view of a twist sensing drum used in the twist detector.
Figure 4:
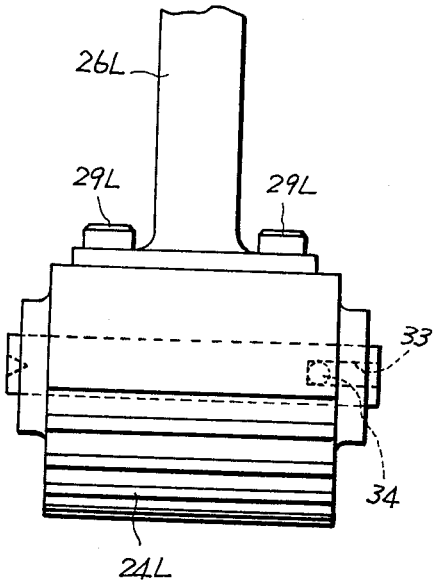
FIG. 4 is a side view of FIG. 3.

Referring to the drawings, first to FIGS. 1 and 2, there is shown a roped continuous web 10 of knit or woven fabric having twist formed in the previous processing of the fabric. The roped web is taken out of a bin 11, moved upward through a detwister 12 and passed about a spider sheave 13 and then a guide roller 14 so to be directed downward. The running rope 11 then passes a twist detecting device 15, which detects the twist in the rope and sends a corrective signal to the detwister through a control circuit to cause it to operate to remove the twist in the manner to be described later in detail. The rope is then opened or spread by a cloth guider 16 in a manner well known in the art and the web now in open width is sent to the next stage of the process.

The twist detecting device 15 comprises a pair of detectors 21R, 21L which are of substantially the same or symmetrical construction so that explanation of only one of the two will suffice with the corresponding parts of the detectors being designated by the same reference numerals suffixed by L and R, respectively.

Each detector 21R, 21L comprises a generally cylindrical drum 22R, 22L which has an axial shaft 23R, 23L and a plurality of parallel axial grooves 24R, 24L formed on a predetermined angular area of the circumferential surface thereof. A rear part of the circumferential surface of the drum is made flat as at 25R, 25L. An actuating rod 26R, 26L has an integral connecting base plate 27R, 27L which is secured by means of bolts 29R, 29L to the flat surface 25R, 25L of the drum, so that the rod extends substantially horizontally and rearwardly of the drum for the purpose to be described later.

Figure 6:
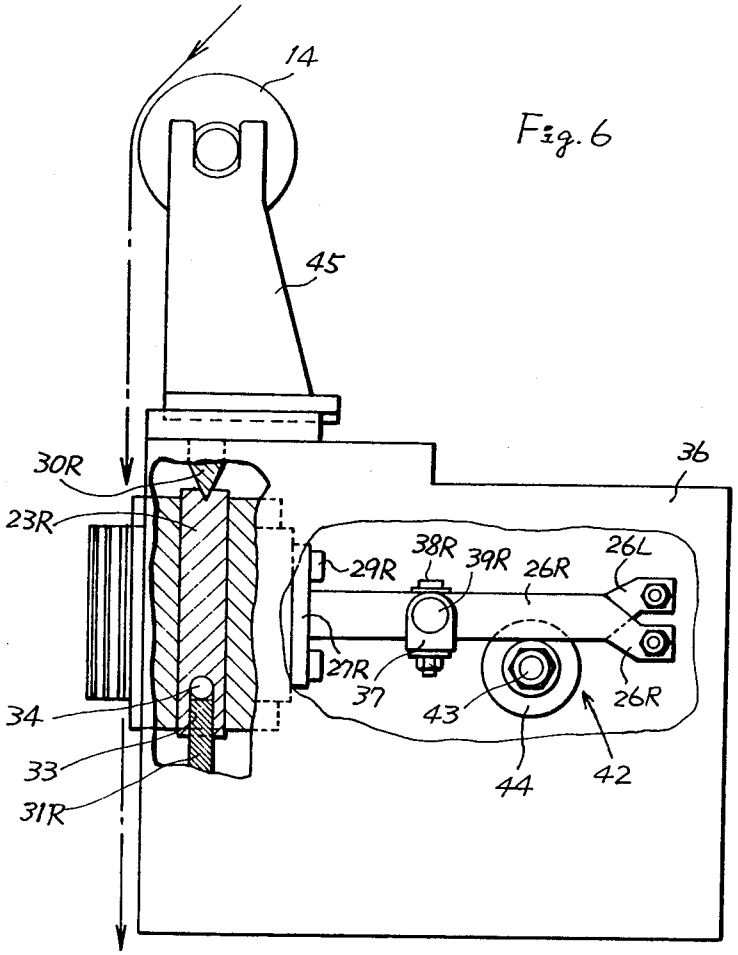
FIG. 6 is a side view of the twist detector.

Each drum 22R, 22L is rotatably supported, with the pointed lower end of a bearing pin 30R, 30L engaging the upper end of the axial shaft 23R, 23L and the upper end of a lower bearing pin 31R, 31L being inserted into an axial bore 33 formed in the lower end of the axial shaft so as to bear against a ball 34 interposed therebetween (FIGS. 1 and 6).

A guide rod 35R, 35L is secured to the underside of a frame **36*a*** so that the guide rod extends substantially horizontally and forwardly of the drum for the purpose to be described later.

The two sensing drums 22R and 22L are supported by an inner frame 36 so that they are spaced a suitable distance apart from each other, with their axes of rotation extending vertically parallel with each other, and parts of the circumferential surfaces of the drums project at the front side of the frame 36 with the actuating rods 26R and 26L extending within the frame 36 rearwardly of the drums. The guide rods 35R and 35L are disposed below the drums and project horizontally forwardly beyond the front sides of the drums as best shown in FIG. 5 so as to define therebetween a space S through which the roped web 10 passes thereby to prevent the web from getting out of the space.

Figure 5:
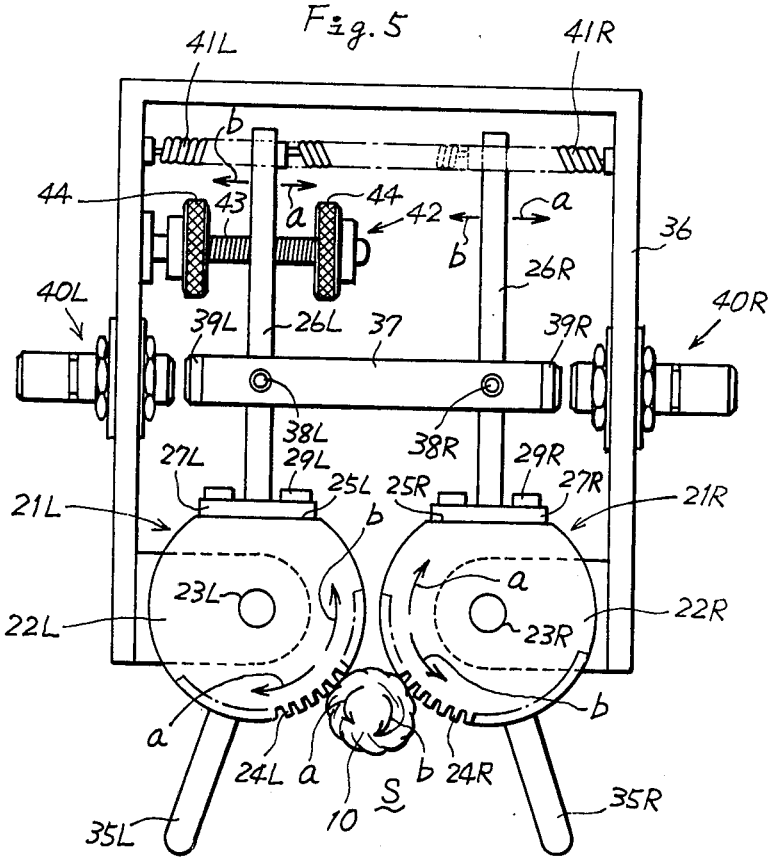
FIG. 5 is a top plan view of the twist detector.

A switching bar 37 is connected by a pair of pivot pins 38R and 38L to the intermediate points of the actuating rods 26R and 26L, respectively, as best shown in FIG. 5. The bar 37 is provided at the opposite ends thereof with a pair of actuating members 39R and 39L. A pair of switches 40R and 40L such as proximity switches are provided on the opposite lateral sides of the frame 36 at such positions are to be alternatively actuated by the members 39R and 39L.

The switches are included in a control circuit to be described later. A coil spring 41L is tensioned between the rear end of the rod 26R and one of the opposite side walls of the frame 36 so as to bias the rod and consequently the drum 22R counterclockwise in FIG. 5, while a coil spring 41R is tensioned between the rear end of the rod 26L and the opposite side wall of the frame 36 so as to bias the rod 26L and consequently the drum 22L clockwise in FIG. 5.

An adjustable stopper 42 comprises a screw rod 43 with a spaced pair of nuts 44 threaded thereon, between which the actuating rod 26L transversely passes. It will be easily seen that by adjusting the relative positions of the nuts along the screw rod it is possible to control the swing stroke of the bar 37 so as to prevent the actuating member 39R or 39L from hitting the corresponding switch 40R or 40L thereby to cause rapid wear or damage thereto.

The previously mentioned guide roller 14 is supported on the top end of a bracket 45 mounted on the upper wall of the frame 36. The bracket 45 is positionally adjustable horizontally on the top wall of the frame 36 so that the roller 14 properly guides the roped web passing between the grooved circumferential surfaces 24R and 24L of the sensing drums axially thereof so that the twist in the rope can be properly detected by the drums.

In operation, as shown in FIG. 1 as the roped continuous web 10 of knit or woven fabric is spread and opened by the cloth guider 16 disposed below the twist detecting device 15, the upper apex 10*a* of the triangular portion 10*b* of the web above the cloth guider is displaced upwardly toward the twist detecting device.

This upward displacement of the apex 10*a* causes the twist in the rope adjacent the detecting device 15 to be tightened or increased, so that the twisted surface of the roped web in sliding contact with the grooved surfaces 24R and 24L of the drums causes them to rotate about their respective axes of rotation in the same direction.

Suppose that the rope is twisted sinistrorse or counterclockwise as indicated by the arrow *a* in FIGS. 1 or 5. When the twist is tightened, the tightened, twisted portion of the rope in sliding contact with the grooved peripheral surface of either one or both of the drums causes them to rotate about their respective axes simultaneously clockwise as indicated by the arrow *a* in FIG. 5, so that the actuating rods 26R and 26L are swung rightwards as far as the right-hand actuating member 39R actuates the switch 40R.

Figure 7:
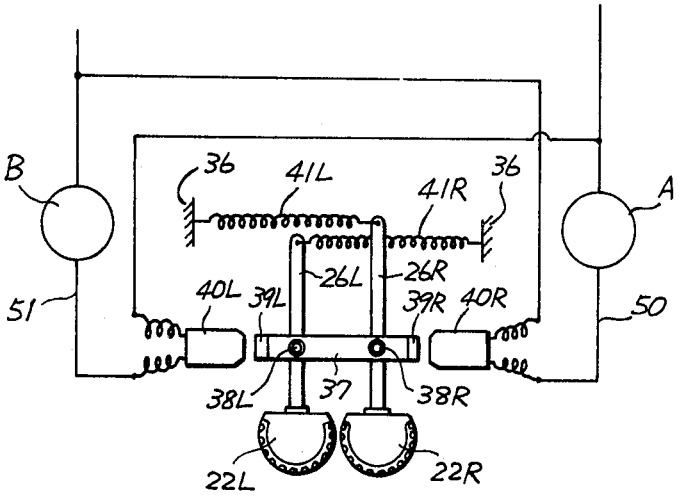
FIG. 7 is a diagram of a circuit for controlling the relays in the motor conrol circuit shown in FIG. 8.

Turning to FIG. 7, the switch 40R is connected in a line 50 in series with a relay A, while the switch 40L is connected in series with a relay B in a line 51 which is parallel with the line 50.

Figure 8:
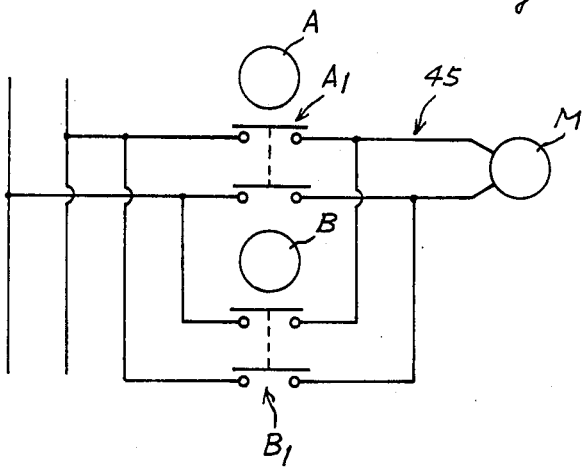
FIG. 8 is a diagram of the circuit for controlling the motor in the detwister.

When the member 39R actuates the switch 40R, the relay A is energized to close a relay contact A1 connected in an energizing circuit 45 for the motor M of the detwister as shown in FIG. 8 so that the motor M is energized to rotate in such a direction that the sinistrorse twist in the rope is loosened or eliminated.

Suppose on the contrary that the rope is twisted clockwise or dextrorse, that is, in the opposite direction as indicated by an arrow *b* in FIG. 5. When the twist is tightened, the drums are rotated counterclockwise in FIG. 5, so that the left-hand actuating member 39L actuates the switch 40L. This energizes the relay B, whereupon a relay contact B1 connected in the motor energizing circuit 45 in parallel with the relay A is closed to energize the motor M so as to be rotated in the opposite direction so that the dextrorse twist is loosened and eliminated.

So long as there is no twist in the rope or the twist is comparatively loose, the detector does not respond immediately until the twist is sufficiently tightened.

Seams, folds, creases formed in the web of fabric or foreign substances attached thereto do not obstruct the detecting operation of the detector. Some prior art twist detectors unnecessarily responded to too loose twist or such obstacles. However, the twist detector of this invention neither respnds to such loose twist or obstacles nor makes errors in detection.

What I claim is:

1. A twist detecting device for use in a detwisting apparatus for a roped web of knit or woven fabric in a fabric processing system comprising: a pair of sensing drums each having a plurality of axial grooves formed on at least a portion of the circumferential surface thereof, and a rod fixed to another portion of said circumferential surface of each said drum so as to extend laterally therefrom perpendicularly to the axis thereof; said drums being arranged side by side with their respective axes extending in parallel with each other and said grooved surfaces facing in the same direction and said rods extending side by side in parallel with each other; said drums being separated by a space between said grooved surfaces so that said roped web passes through said space in a direction generally parallel with said grooves; means for supporting said drums rotatably about their respective axes so that as said twist in said rope is tightened, engagement of said twisted rope with said grooves on said drums causes simultaneous rotation of said drums and consequently swinging of said rods in the same direction; an actuating bar pivotally connected to said rods so that upon simultaneous swinging of said rods said actuating bar is moved generally axially in either direction, whereby the direction of the twist in said roped web is detected by the direction of movement of said bar; and means for detecting the direction of movement of said bar to produce a corresponding electrical signal.

2. The device of claim 1, wherein said detecting means comprises a pair of electrical switches spaced a predetermined distance apart from the opposite axial ends of said bar so that said switches are alternatively actuated by one of said axial ends.

3. The device of claim 1, further including means for biasing each of said rods in opposite directions.

4. The device of claim 3, wherein said biasing means comprises a first resilient means connected to one of said rods to urge said one rod to swing about said axis of one of said drums in one direction and a second resilient means connected to the other of said rods to urge said other rod to swing about said axis of the other of said drums in the opposite direction.

5. The device of claim 2, further including means for limiting the swinging movement of said rods and consequently the axial movement of said actuating bar so as to prevent said opposite axial ends of said actuating bar from hitting on said switches.

6. The device of claim 5, wherein said limiting means comprises a pair of stoppers spaced apart from each other and arranged at the opposite lateral sides of one of said rods.

7. The device of claim 1, further including means for guiding said roped web so that said web passes through said space in sliding contact with said grooved surfaces of said drums in a direction generally parallel with said grooves.

8. The device of claim 7, wherein said guiding means comprises a sheave positioned above said drums and a pair of horizontally spaced apart guide rods each disposed below one of said drums.

* * * * *